US009637857B2

(12) United States Patent
Del Pos et al.

(10) Patent No.: US 9,637,857 B2
(45) Date of Patent: May 2, 2017

(54) LAUNDRY WASHING MACHINE

(75) Inventors: Maurizio Del Pos, Pordenone (IT); Monica Celotto, Motta di Livenza (IT); Nicola Reid, Budoia (IT); Elisa Stabon, Gorlzia (IT); Maurizio Ugel, Fiume Veneto (IT); Andrea Zattin, Budoia (IT)

(73) Assignee: Electrolux Home Products Corporation N.V., Brussels (BE)

( * ) Notice: Subject to any disclaimer, the term of this patent is extended or adjusted under 35 U.S.C. 154(b) by 46 days.

(21) Appl. No.: 14/130,054

(22) PCT Filed: Jun. 26, 2012

(86) PCT No.: PCT/EP2012/062362
§ 371 (c)(1),
(2), (4) Date: Feb. 28, 2014

(87) PCT Pub. No.: WO2013/000914
PCT Pub. Date: Jan. 3, 2013

(65) Prior Publication Data

US 2014/0165663 A1 Jun. 19, 2014

(30) Foreign Application Priority Data

Jun. 30, 2011 (EP) ..... 11172257

(51) Int. Cl.
*D06F 39/08* (2006.01)
*D06F 39/02* (2006.01)
*A47L 15/44* (2006.01)

(52) U.S. Cl.
CPC ..... *D06F 39/028* (2013.01); *A47L 15/44* (2013.01); *A47L 15/4418* (2013.01);
(Continued)

(58) Field of Classification Search
None
See application file for complete search history.

(56) References Cited

FOREIGN PATENT DOCUMENTS

CN 2154274 Y 1/1994
CN 1084192 A 3/1994
(Continued)

OTHER PUBLICATIONS

International Search Report mailed Nov. 30, 2012 in corresponding International Application No. PCT/EP2012/062362.
(Continued)

*Primary Examiner* — Michael Barr
*Assistant Examiner* — Jason Riggleman
(74) *Attorney, Agent, or Firm* — Banner & Witcoff, Ltd.

(57) ABSTRACT

A laundry washing machine (1) has a casing (2) supporting a washing tub (3) external to a washing drum (4) suitable to receive the laundry to be washed, and a detergent supply system (5; 35; 55; 65; 105) comprising a mixing chamber (6; 56; 86; 106) suitable to receive detergent (D) and water (W). A mixing device (20; 40; 100) suitable to mix the detergent (D) and the water (W) in the mixing chamber (6; 56; 86; 106) to form a washing solution (S) is provided. The mixing chamber (6; 56; 86; 106) and the mixing device (20; 40; 100) are disposed inside the casing (2) and the mixing chamber (6; 56; 86; 106) comprises an inlet (7; 57; 87; 107) accessible from outside the casing (2) for the insertion of the detergent (D) and an outlet (14; 94) for delivering the washing solution (S) in the washing tub (3).

9 Claims, 10 Drawing Sheets

(52) U.S. Cl.
CPC ..... *D06F 39/02* (2013.01); *D06F 39/022* (2013.01); *D06F 39/083* (2013.01)

(56) References Cited

FOREIGN PATENT DOCUMENTS

| | | | |
|---|---|---|---|
| CN | 1111698 | A | 11/1995 |
| CN | 1712622 | A | 12/2005 |
| CN | 1715525 | A | 1/2006 |
| DE | 4439680 | | 6/1996 |
| DE | 102007041643 | | 3/2009 |
| DE | 102007041643 | A1 | 3/2009 |
| EP | 0864684 | A1 * | 6/1996 |
| EP | 0864684 | | 9/1998 |
| EP | 0864684 | A1 | 9/1998 |
| EP | 0864684 | A1 * | 9/1998 |
| EP | 1867773 | A1 | 12/2007 |
| EP | 1884584 | | 2/2008 |
| EP | 2011913 | | 1/2009 |
| EP | 2011913 | A1 * | 1/2009 |
| EP | 2011913 | A1 | 1/2009 |
| EP | 2241669 | A1 * | 4/2009 |
| EP | 2241669 | | 10/2010 |
| JP | 10-192071 | | 7/1998 |
| JP | 200817943 | | 1/2008 |
| WO | 03022121 | | 3/2003 |

OTHER PUBLICATIONS

Extended European Search Report dated Dec. 16, 2011 in corresponding European Application No. 11172257.5.

* cited by examiner

LAUNDRY WASHING MACHINE

The present invention concerns the field of laundry washing techniques.

In particular, the present invention refers to a laundry washing machine comprising a detergent supply system.

BACKGROUND ART

Nowadays the use of laundry washing machines, both "simple" laundry washing machines (i.e. laundry washing machines which can only wash and rinse laundry) and washing-drying machines (i.e. laundry washing machines which can also dry laundry), is widespread.

In the present description the term "laundry washing machine" will refer to both simple laundry washing machines and laundry washing-drying machines.

Laundry washing machines generally comprise an external casing provided with a washing tub inside which there is a rotatable perforated drum in which the laundry is placed.

A loading/unloading door ensures access to the tub and the drum.

Laundry washing machines typically comprise a detergent supply unit containing washing and/or rinsing products (i.e. detergent, softener, etc.) and a water inlet circuit for supplying water. The detergent supply unit, usually consisting of a removable drawer, and the water inlet circuit preferably co-operate to allow the introduction of the water and the washing/rinsing products into the tub during the laundry washing cycle.

A washing cycle typically includes a first phase, or wetting phase, during which a pre-determined quantity of detergent is put inside the tub on the laundry together with a quantity of wetting water.

The water is supplied into the tub by making it flow through the drawer. In this way the introduction of the prefixed quantity of detergent is brought out of the apposite compartment of the drawer by the flow of clean water that passes through the proper compartment of the drawer itself.

According to a known technique, the initial wetting phase includes the step of mixing a predetermined amount of detergent with water to form a solution which is introduced in the tub for wetting the laundry.

A wetting method belonging to the know technique is disclosed in document EP864684A1. In this document a method and a system for dosing detergent to a washing machine is described.

The dosing system comprises a supply holder for detergent and a mixing chamber for mixing the detergent with a solvent (preferably water) in a predetermined concentration range to form a liquor. The system also comprises control means for supplying the content of the mixing chamber to a remote washing machine once the liquor is prepared inside the mixing chamber. A dose controlling unit is further connected to a pump disposed in the line between the mixing chamber and the remote washing machine in order to ensure that the desired amount of detergent is supplied to the washing machine.

However, the system for mixing detergent with water above described belonging to the known art poses some drawbacks.

A first drawback posed by this known technique is constituted by the complexity of the system for mixing detergent with water.

A further drawback of the known technique is represented by the fact that the system for mixing detergent with the solvent is cumbersome.

SUMMARY OF SELECTED INVENTIVE ASPECTS

The main object of the present invention is therefore to overcome said drawbacks.

In particular, it is one object of the present invention to provide a laundry washing machine with a system for mixing detergent presenting a reduced constructional complexity with respect to the laundry washing machine of known type.

Another object of the present invention is to provide a laundry washing machine with a system for mixing detergent which is easier to use than the laundry washing machine of known type.

The present invention therefore relates, in a first aspect thereof, to a laundry washing machine comprising:

- a casing supporting a washing tub external to a washing drum suitable to receive the laundry to be washed;
- a detergent supply system comprising a mixing chamber suitable to receive detergent and water and comprising a mixing device suitable to mix said detergent and said water in said mixing chamber to form a washing solution, said mixing chamber and said mixing device being disposed inside said casing and said mixing chamber comprising an inlet accessible from outside of the casing for the insertion of said detergent and an outlet for delivering said washing solution in said washing tub.

In a preferred embodiment the mixing chamber is stationary with respect to the casing.

In a further preferred embodiment the mixing chamber is slidable with respect to the casing.

Preferably the detergent supply system comprises a mixing device suitable to mix the detergent and the water inside the mixing chamber.

Preferably the mixing device comprises a recirculating device.

Advantageously the recirculating device comprises a recirculating circuit with a recirculating pump.

In a preferred embodiment of the invention the detergent and the water are substantially mixed along said recirculating circuit.

In a further preferred embodiment the mixing device comprises a mechanical mixer.

Advantageously the mechanical mixer comprises turbine blades.

Preferably the laundry washing machine comprises a dispenser having at least one compartment suitable to receive washing and/or rinsing products and the outlet of the mixing chamber communicates with the compartment.

Advantageously the dispenser and the mixing chamber form a module connectable to the casing.

Opportunely the outlet comprises a delivery pump.

Preferably the dispenser comprises a removable drawer.

In a preferred embodiment the removable drawer and the mixing chamber form an integral unit slidable with respect to the casing.

Advantageously the laundry washing machine comprises an interface unit through which the user may select a washing program using the mixing chamber to form a washing solution.

In a second aspect thereof, the present invention concerns a detergent supply system for a laundry washing machine comprising a mixing chamber suitable to receive detergent and water and comprising a mixing device suitable to mix said detergent and said water in said mixing chamber to form a washing solution, wherein the detergent supply system is suitable to be installed inside said laundry washing machine and comprises an inlet accessible from outside of the laundry washing machine for the insertion of said detergent and an outlet for delivering said washing solution.

BRIEF DESCRIPTION OF THE DRAWINGS

Further characteristics and advantages of the present invention will be highlighted in greater detail in the following detailed description of some of its preferred embodiments, provided with reference to the enclosed drawings. In said drawings.

DETAILED DESCRIPTION OF THE EXAMPLE EMBODIMENTS

A laundry washing machine 1 according to a first embodiment of the invention is described here below with reference to Figures from 1 to 4.

Figure 1:
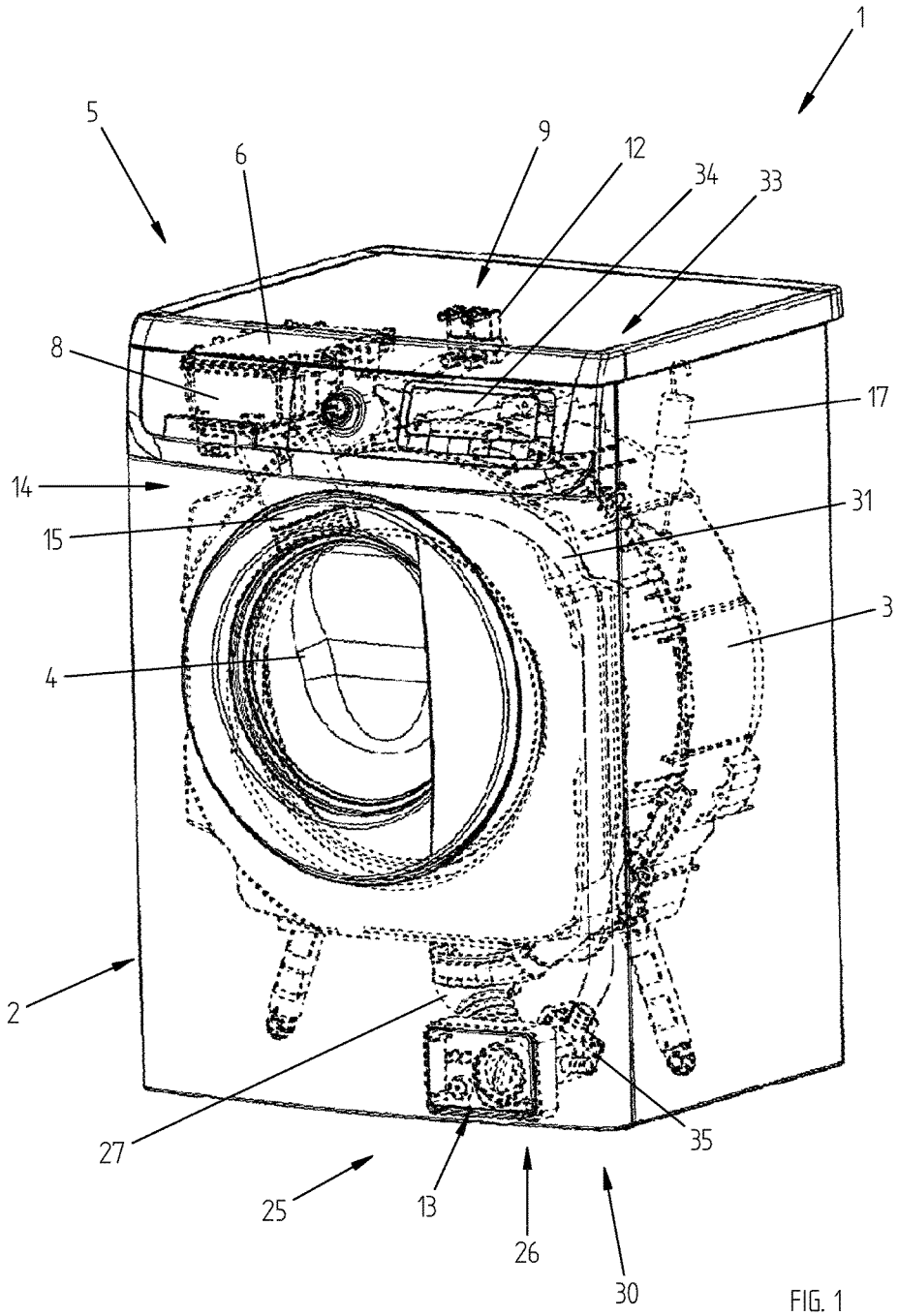
FIG. 1 shows a isometric view of a laundry washing machine according to a first embodiment of the invention.
Figure 2:
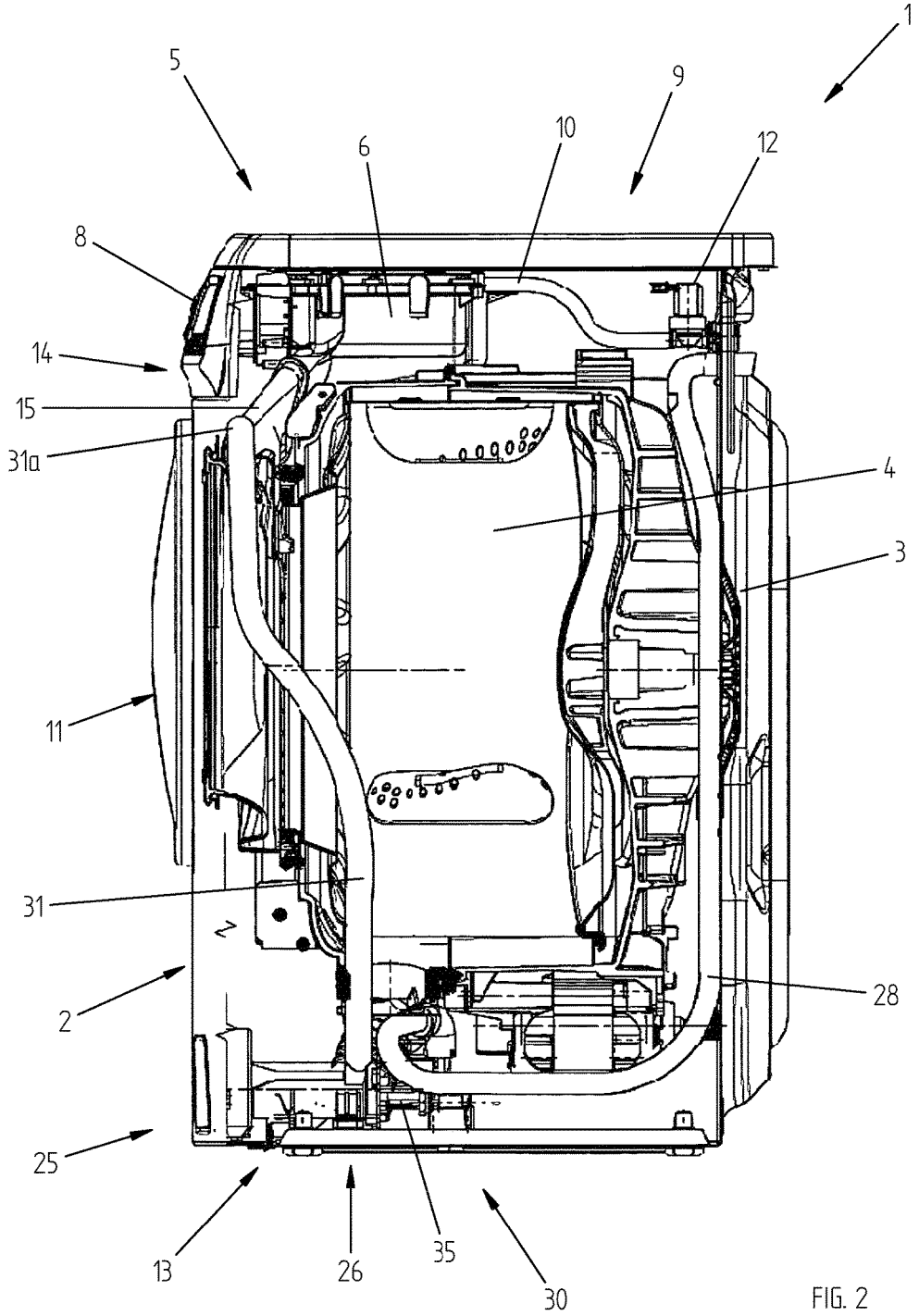
FIG. 2 shows a side view of the laundry washing machine shown in FIG. 1.

The laundry washing machine 1 shown in FIGS. 1 and 2 is a front loading washing machine. The present invention has proved to be particularly successful when applied to front loading laundry washing machines. It should in any case be underlined that the present invention is not limited to this type of application. On the contrary, the present invention can be usefully applied to different types of loading washing devices, as for example top loading laundry washing machines or laundry washing-drying machines.

The laundry washing machine 1 comprises an external casing or casing 2, in which a washing tub 3 is provided that contains a rotatable perforated drum 4, where the laundry to be washed can be loaded.

The tub 3 and the drum 4 both have preferably a substantially cylindrical shape.

The casing 2 is provided with a loading/unloading front door 11 which allows access to the washing tub 3 and the drum 4.

The tub 3 is preferably suspended in a floating manner inside the casing 2, advantageously by means of a number of coil springs and shock-absorbers 17.

The tub 3 is preferably connected to the casing 2 by means of an elastic bellows, or gasket.

The drum 4 is advantageously rotated by an electric motor which preferably transmits the rotating motion to the shaft of the drum 4, advantageously by means of a belt/pulley system. In a different embodiment of the invention, the motor can be directly associated with the shaft of the drum 4.

A detergent supply system 5 is preferably arranged in the upper part of the laundry washing machine 1.

With the term detergent we will refer hereinafter to any washing products suitable for washing the laundry, as for example a detergent in powder form or a detergent in liquid form.

The detergent supply system 5 is suited to supply water W and detergent D into the tub 3, as better described in the following of the description.

The detergent supply system 5 advantageously comprises a container 6 of suitable size, as better described later, provided with an aperture 7 closable by means of an access door 8 associated to the casing 2.

Opening of the access door 8 allows the insertion of a suitable quantity $Q_d$ of detergent D inside the container 6.

Figure 3:
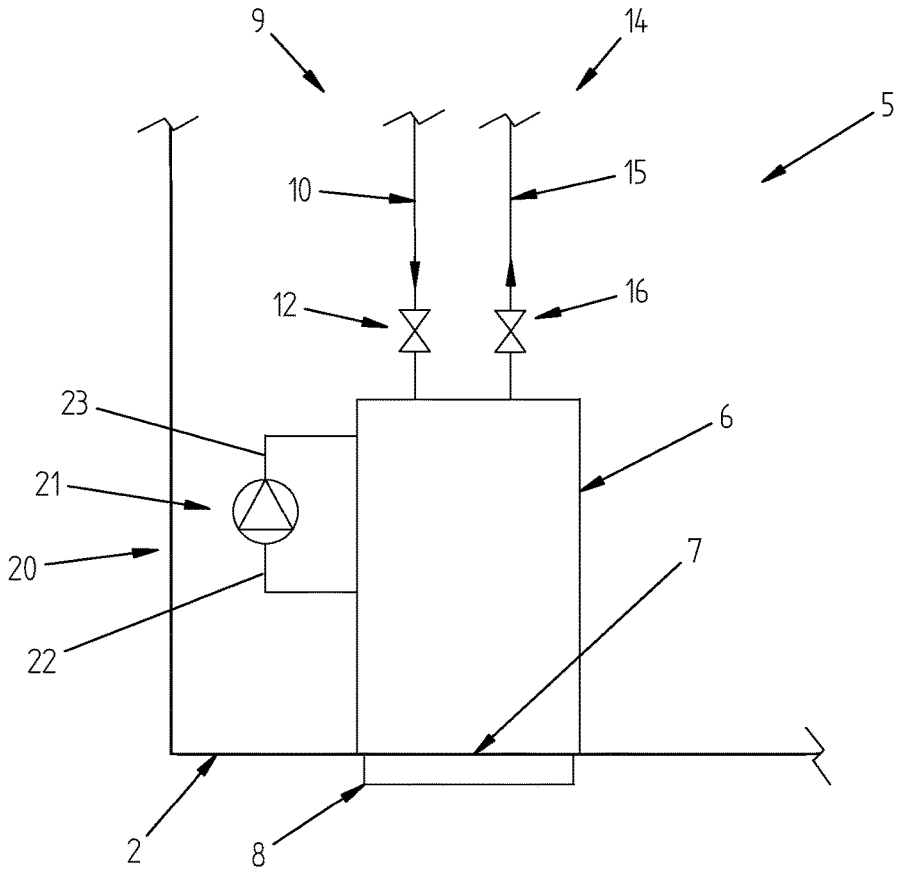
FIG. 3 shows a schematic view of a particular of FIG. 1.
Figure 4:
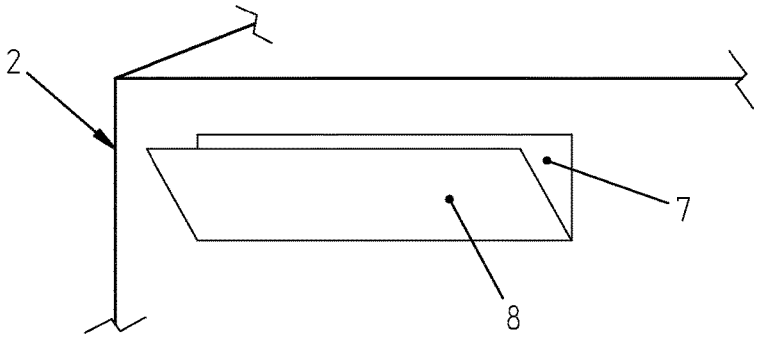
FIG. 4 shows a front view of a particular of the laundry washing machine shown in FIG. 1.

The detergent supply system 5 advantageously comprises an inlet water line 9 to supply clean water W into the container 6, as shown in FIG. 3.

The inlet water line 9 preferably comprises at least one supply pipe 10, connected to an external water supply line, provided with a first input valve 12 properly controlled. In further embodiments the inlet water line may comprises further supply pipes provided with respective input valves, as for example when an external hot water supply line is also available.

In the preferred embodiment the water flows into the container 6 from the external water supply line thanks to its own pressure. In a further embodiment a supply pump properly controlled may be provided along the supply pipe 10.

The inlet water line 9 also preferably comprises a water flow sensor, for example a flow meter, which makes it possible to calculate the quantity of water W supplied into the container 6.

The detergent supply system 5 advantageously comprises an output circuit 14 to allow withdrawing of liquid from the container 6.

The output circuit 14 preferably comprises a delivery pipe 15, provided with a delivery valve 16 properly controlled.

The delivery pipe 15 preferably ends in correspondence of an upper portion of the tub 3 in the proximity of the front door 11.

The delivery pipe 15 is preferably connected to the bottom of the container 6 and the liquid may fall from the container 6 into the tub 3.

In a further embodiment a delivery pump properly controlled may be provided along the delivery pipe 15.

The detergent supply system 5 advantageously comprises a mixing device 20 which is applied to the container 6 and comprises a recirculation mixing pump 21, an inlet connecting line 22 connecting the recirculation mixing pump 21 to the container 6 and an outlet connecting line 23 connecting the recirculation mixing pump 21 to the container 6.

The recirculation mixing pump 21 is activated to recirculate the liquid inside the container 6. The recirculation mixing pump 21 withdraws liquid from the container 6 via the inlet connecting line 22 and discharges the liquid withdrawn back into the container 6 via the outlet connecting line 23.

The laundry washing machine 1 advantageously comprises a water outlet circuit 25, as shown in FIGS. 1 and 2.

The water outlet circuit 25 advantageously comprises a drain pump 26, a first pipe 27 connecting the tub 3 to the drain pump 26 and an outlet pipe 28 ending outside the casing 2. The water outlet circuit 25 is suited to drain the liquid, i.e. dirty water or water mixed with washing and/or rinsing products, from the tub 3 to the outside.

The water outlet circuit 25 is advantageously provided with a recirculation circuit 30 adapted to drain liquid from a bottom region of the tub 3 and to re-admit such a liquid into a higher region of the tub 3.

The recirculation circuit 30 comprises the drain pump 26 and a recirculation pipe 31. The recirculation pipe 31 advantageously ends with a terminal nozzle 31*a* in an upper region of the tub 3 and in the proximity of the front door 11.

A two-way valve 35 is preferably interposed between the drain pump 26, the outlet pipe 28 and the recirculation pipe 31.

The two-way valve 35 is preferably properly controlled in order to allow selective drainage towards the outside through the outlet pipe 28 or towards the upper region of the tub 3 through the recirculation pipe 31.

In a further embodiment, not illustrated, the recirculation circuit may comprise a dedicated recirculation pipe connecting a bottom region of the tub with and higher region of the latter, and provided with a dedicated recirculation pump; in this case the recirculation circuit is advantageously completely separated from the water outlet circuit.

The water outlet circuit 25 advantageously comprises a filtering device 13 placed between the bottom of the tub 3 and the drain pump 26 and adapted to retain all the undesirable bodies (for example buttons that have come off the laundry, coins erroneously introduced into the laundry washing machine, etc.) that have passed through the holes located on the surface of the drum 4, or fallen onto the bottom of the tub 3 while passing in the hollow space between the drum 4 and the tub 3, which could damage or obstruct the drain pump 26.

Advantageously, the laundry washing machine 1 comprises a heating device, not illustrated herein, adapted to heat the laundry and/or the water inside the laundry and/or the free water inside the tub 3. A heating device may be, for example, an electric resistor placed on the bottom of the tub or a hot air supply system or a steam supply system.

Advantageously the laundry washing machine 1 comprises a temperature sensor, not illustrated in the figures, for sensing the temperature inside the tub 3.

Laundry washing machine 1 advantageously comprises a control unit 33 connected to the various parts of the laundry washing machine 1 in order to ensure its operation. The control unit 33 preferably is connected to the detergent supply system 5, the water outlet circuit 25, the heating device and the electric motor and receives information from the various sensors provided on the laundry washing machine 1, like the flow meter of the water inlet circuit 9, the temperature sensor, etc.

Laundry washing machine 1 advantageously comprises an interface unit 34 connected to the control unit 33, accessible to the user and by means of which the user may select and set the washing parameters, like for example a desired washing program. Usually, other parameters can optionally be inserted by the user, for example the washing temperature, the spinning speed, the load in terms of weight of the laundry to be washed, etc.

Based on the parameters acquired by said interface 34, the control unit 33 sets and controls the various parts of the laundry washing machine 1 in order to carry out the desired washing program.

The preferred embodiment of the laundry washing machine 1 and of the detergent supply system 5 works as follows.

The laundry to be washed is first placed inside the drum 4. By operating on the interface unit 34 the user selects the desired washing program depending, for example, on the type and on the dirty-level of the products to wash. Furthermore, as said before, in a preferred embodiment it is possible for the user to insert some parameters directly by the interface unit 34, for example the value of the washing temperature, the rotating speed of the drum 4 in the spinning phase, the duration of washing cycle, etc.

The user loads a prefixed quantity Qd of detergent D sufficient for washing the laundry. The user loads the prefixed quantity Qd of detergent inside the container 6 through the aperture 7. The aperture 7 is easily accessible by opening the access door 8.

Once the user has selected the desired washing program, the control unit 33 sets the laundry washing machine 1 so that it starts the washing cycle.

In a further embodiment, the selection of the desired washing program may be performed before placing the laundry into the drum 4.

A first quantity $Q1_w$ of clean water W is then introduced into the container 6 through the supply pipe 10 by opening the first input valve 12.

The first quantity $Q1_w$ of clean water W introduced in the container 6 may be measured, during its introduction, for example by a flow meter provided in the inlet water line 9, or by processing other parameters, for example the pressure of the delivered water and the duration of the water delivery; in this way it is possible to introduce into the container 6 exactly the prefixed quantity $Q1_w$ of clean water W.

The prefixed quantity Qd of detergent D and the first quantity $Q1_w$ of clean water W inside the container 6 form a washing solution S intended to wet the laundry.

The recirculation mixing pump 21 is then activated to recirculate the liquid inside the container 6 in order to prepare a uniform washing solution S.

In fact the recirculation process allows the preparation of a uniform washing solution S wherein the detergent D is properly dissolved or dispersed in the clean water W.

The recirculation process takes place for a predetermined lapse of time $t_r$ so as to guarantee good mixing of the detergent D in the clean water W.

The washing solution S is then introduced in the tub 3 through the delivery pipe 15 by opening the delivery valve 16.

Once the introduction of the washing solution S inside the tub 3 has been completed, the washing program may continue with the following phases of the selected washing cycle.

In the following phases of the washing cycle when further quantities of clean water are required, as for example during the rinse phase, the detergent supply system 5 may be preferably used to supply such a water inside the tub 3.

The required clean water may flow through the supply pipe 10, the container 6 and the delivery pipe 15 by opening the first input valve 12 and the delivery valve 16.

In a further embodiment where a supply pump along the supply pipe 10 is provided, the activation of the supply pump is advantageously carried out during the opening of the first input valve 12 and the delivery valve 16. Analogously in case a delivery pump along the delivery pipe 15 is provided, the activation of the delivery pump is advantageously carried out during the opening of the first input valve 12 and the delivery valve 16.

In an alternative embodiment of the invention, not shown, the laundry washing machine 1 may comprise a separate water supply pipe, separated from the detergent supply system 5, adapted to supply the required clean water directly into the tub 3.

The provision of the container 6 inside the casing 2 and the provision of the mixing device 20 associated to the container 6 leads to obtain a uniform washing solution S for washing the laundry in an easy way.

The size of the container 6 may be advantageously chosen so as to receive a minimum prefixed quantity of washing solution S.

In a preferred embodiment, the size of the container 6 is advantageously chosen so that at least 1 liter of washing solution S may be contained.

Figure 5:
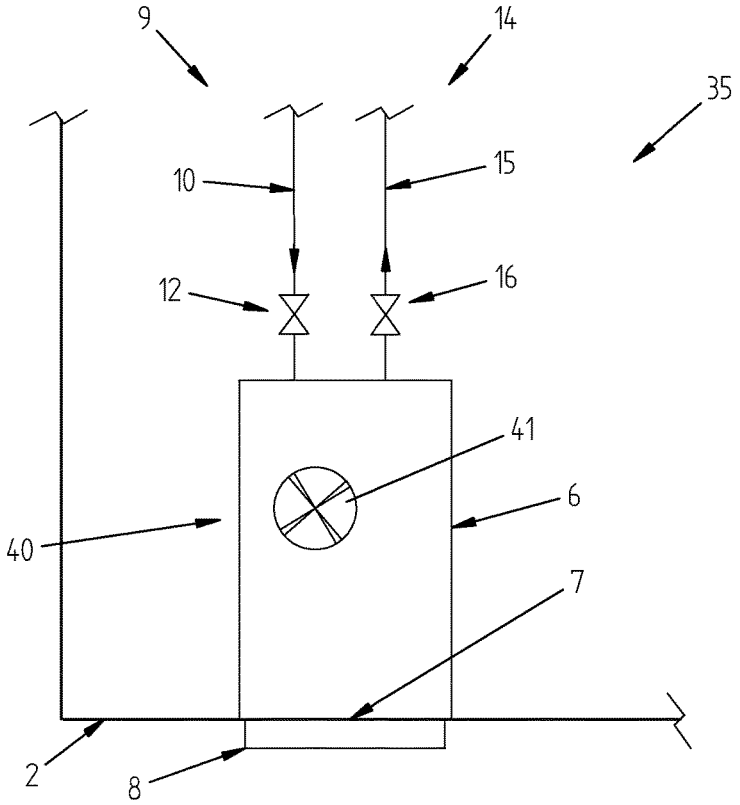
FIG. 5 shows a construction variant of FIG. 3.

FIG. 5 shows a construction variant of the detergent supply system 35.

This detergent supply system 35 differs from the detergent supply system 5 shown in FIG. 3 for the fact that the mixing device 40 comprises a mechanical mixer device. The mechanical mixer device preferably comprises a turbine blades 41 disposed inside the container 6. The turbine blades 41 may be adequately moved to perform a uniform mixing of the solution S inside the container 6. For this purpose rotations of the turbine blades 41 may be advantageously obtained by means of an electric motor connected therewith. In a further embodiment the turbine blades 41 may be moved directly by the action of the water flow coming from the supply pipe 10 when the container 6 is filled with water W. In this case any kind of actuating means for the turbine blades 41 may be advantageously avoided.

With reference to Figures from 6 to 8 a further construction variant of the detergent supply system 55 is described.

Figure 6:
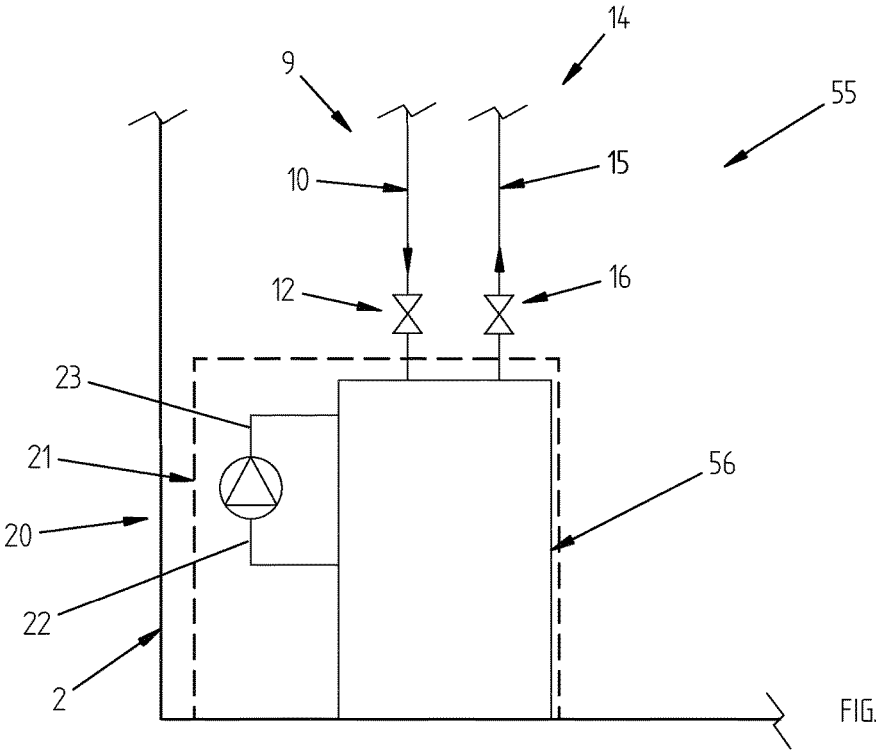
FIG. 6 shows a further construction variant of FIG. 3 in a first operating condition.
Figure 7:
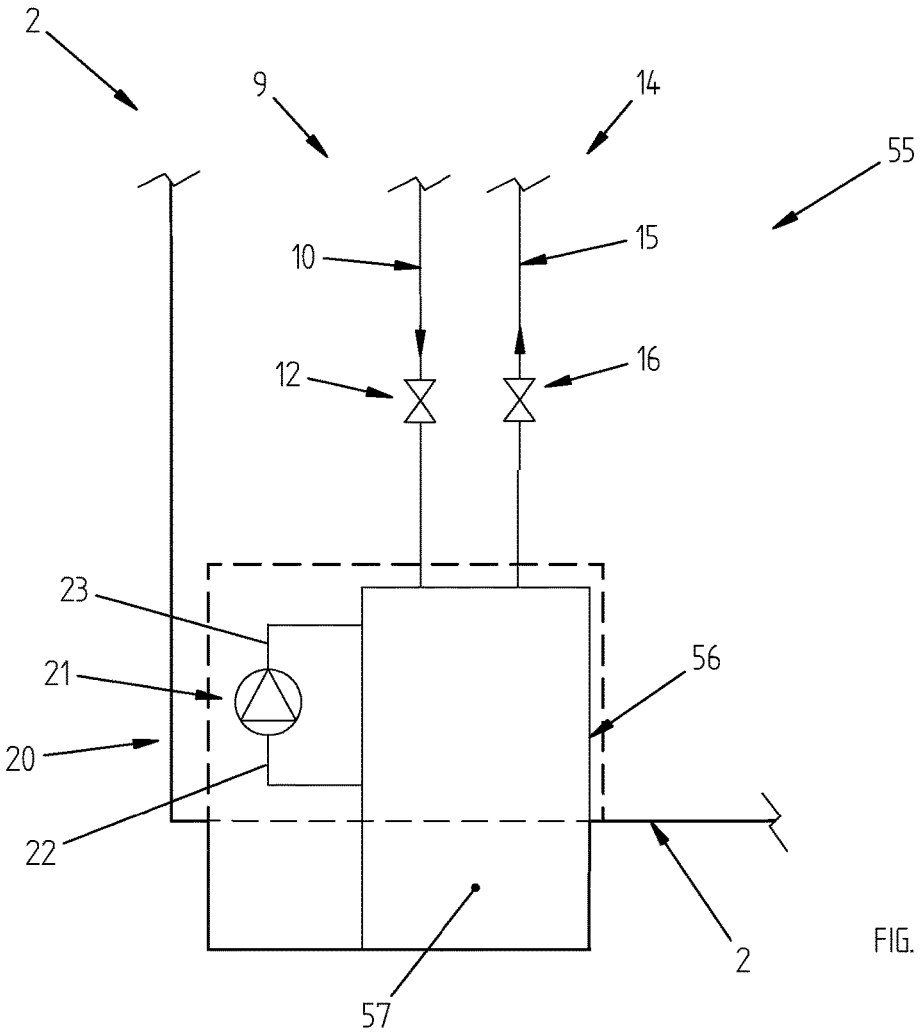
FIG. 7 shows the particular of FIG. 6 in a second operating condition.
Figure 8:
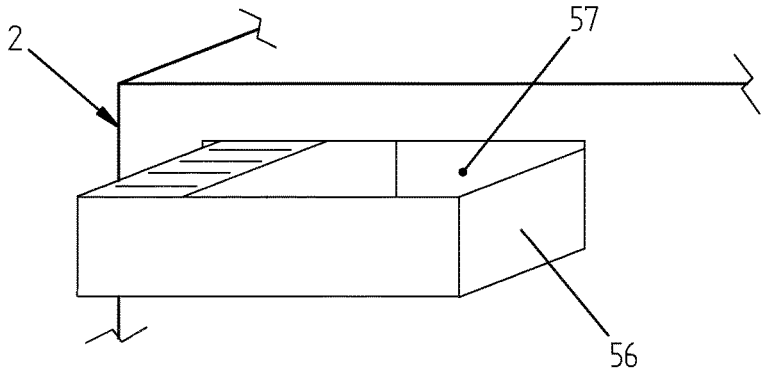
FIG. 8 shows a front view of a particular of the laundry washing machine of the invention referred to the embodiment of FIG. 7.

This detergent supply system 55 differs from the detergent supply system 5 shown in FIG. 3 for the fact that it comprises a container 56 which is open in its upper part so as to define an aperture 57, as shown in FIG. 8. The container 56 is preferably slidable with respect to the casing 2 and may be positioned in a closed first operating condition, as shown in FIG. 6, and in an opened second operating condition, as shown in FIGS. 7 and 8.

In the second operating condition of the detergent supply system 55 the container 56 may be easily filled by the user with detergent D through the aperture 57.

In the first operating condition the detergent supply system 55 may work normally as described above with reference to the first preferred embodiment of Figures from 1 to 4.

This embodiment, therefore, facilitates the load of detergent D inside the container 56.

Positioning of the container 56 in the second operating condition may be advantageously obtained, for example, by using a flexible supply pipe 10 and a flexible delivery pipe 15 which follow the sliding movement of the container 56. In further embodiments, the connection between the container 56 and the supply and delivery pipes 10 and 15 may be removable, like for example a push fit fitting or a snap fitting, so as to guarantee a tight connection in the first operating condition and a fast disconnection when moved towards the second operating condition.

With reference to Figures from 9 to 12 a further construction variant of the detergent supply system 65 is described.

In this embodiment the detergent supply system 65 is associated to a washing/rinsing-liquid dispenser 60 (i.e. a device adapted to dispense water and/or water mixed with washing or rinsing products). The dispenser 60 comprises a box-shaped housing 61, indicated by a dashed line in FIGS. 9 and 10, connected to the external casing 2, internally to the latter, preferably by suitable fixing means, comprising, for example, screws or rivets, not illustrated, or also glue, or welding.

The housing 61 is advantageously substantially parallelepiped, and it is connected to the frontal surface of the external casing 2, opportunely in an upper region of the latter, positioned above the tub 3.

Figure 9:
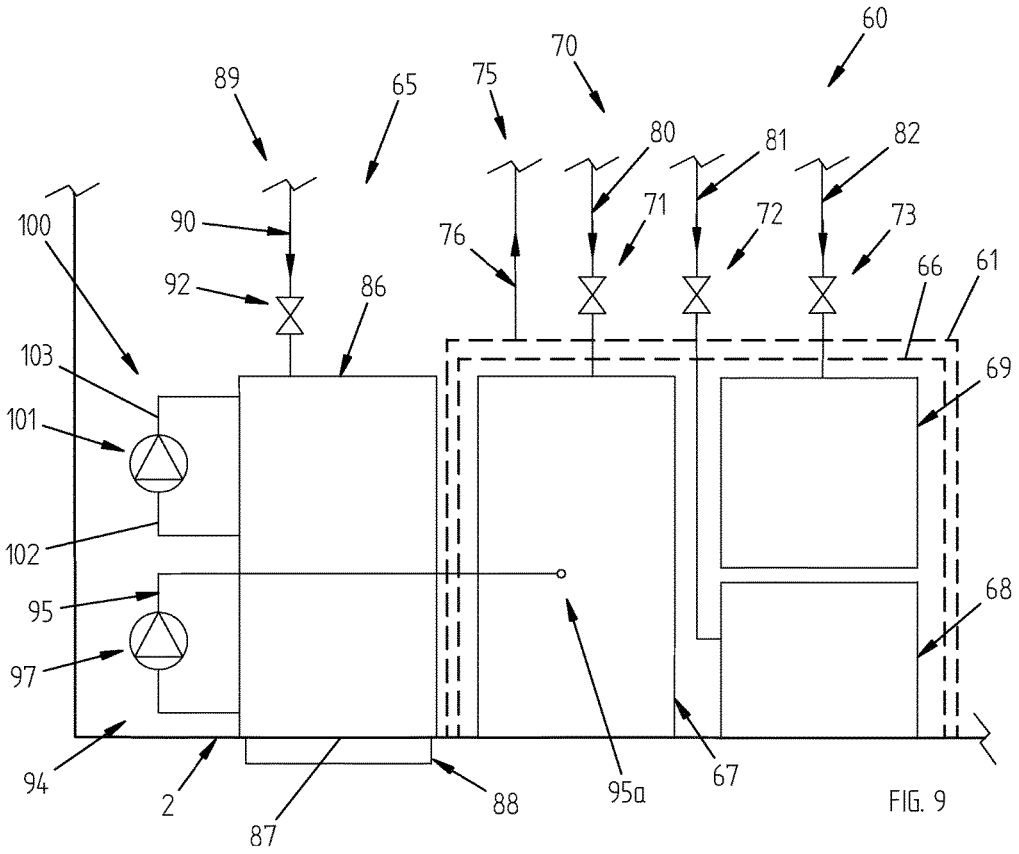
FIG. 9 shows a construction variant of FIG. 3 in a first operating condition.
Figure 10:
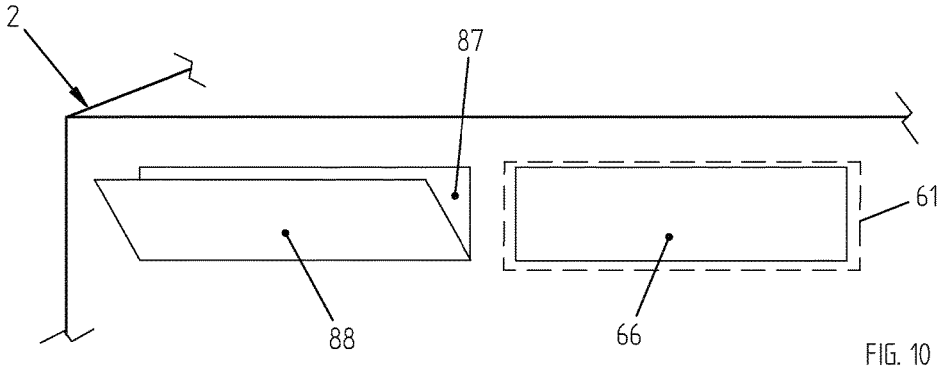
FIG. 10 shows a front view of a particular of the laundry washing machine of the invention referred to in the embodiment of FIG. 9.
Figure 11:
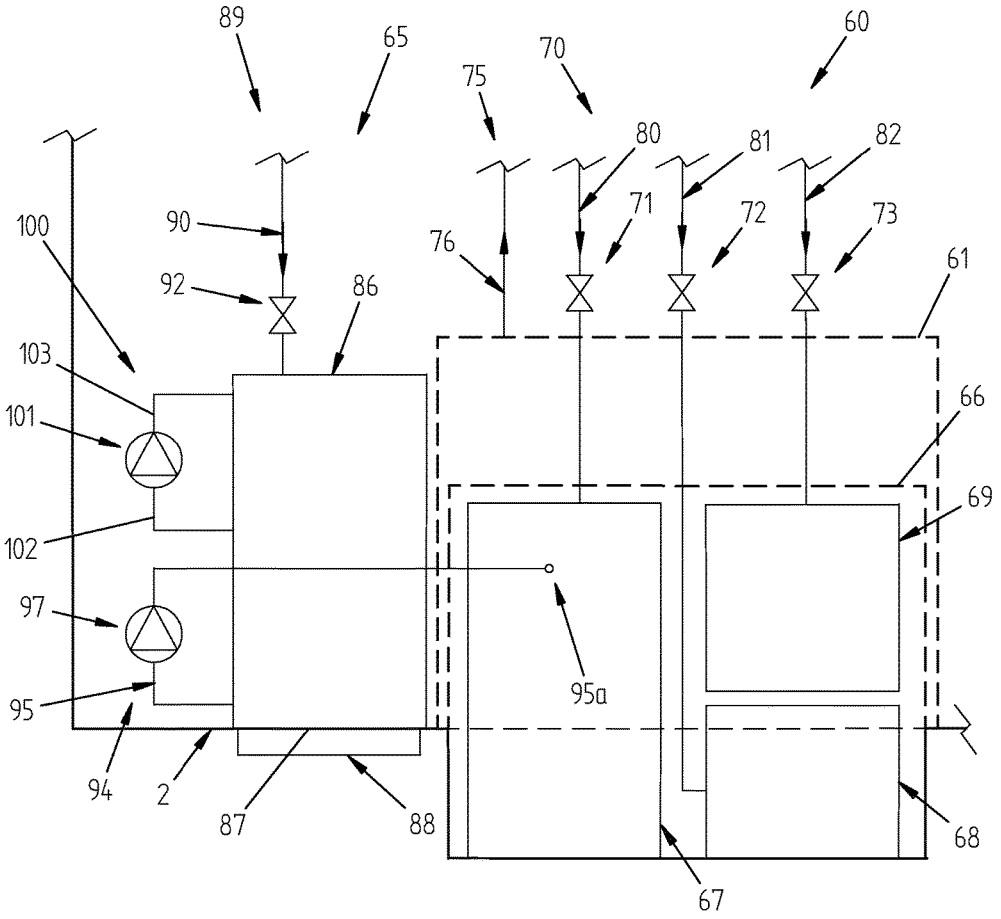
FIG. 11 shows the particular of FIG. 9 in a second operating condition.
Figure 12:
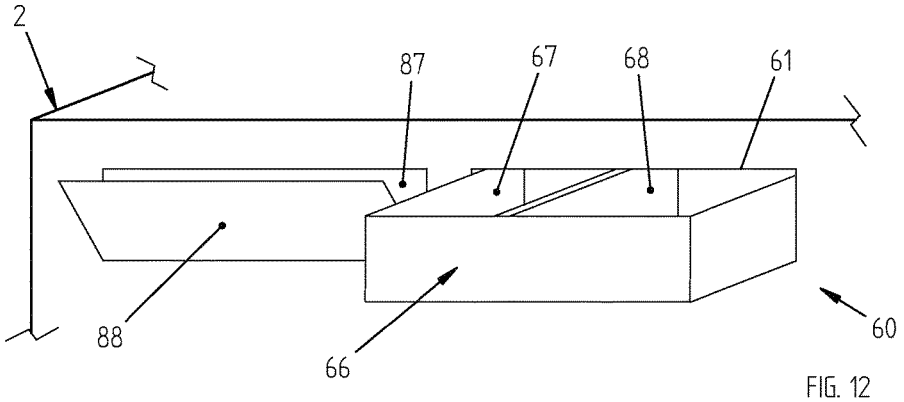
FIG. 12 shows a front view of a particular of the laundry washing machine of the invention referred to in the embodiment of FIG. 11.

The housing 61 contains a removable drawer 66, indicated by a dashed line in FIGS. 9 and 10, which can be extracted from the housing 61 such as to protrude from the external casing 2. The removable drawer 66 is advantageously slidable with respect to the casing 2 and may be positioned in a closed first operating condition, as shown in FIGS. 9 and 10, and in an opened second operating condition, as shown in FIGS. 11 and 12.

The drawer 66 is provided with one or more compartments 67, 68 e 69 adapted to be filled with washing and/or rinsing products, not illustrated. For example, it may comprise a main wash detergent compartment 67, a bleach receiving compartment 68 and a fabric softener receiving compartment 69.

In the second operating condition the compartments 67, 68 and 69 may be easily filled by the user with respective products.

The compartments 67, 68 and 69 communicates with the bottom of the housing 61, in which a liquid delivery circuit 75 is advantageously provided to connect the compartments 67, 68 and 69 to the tub 3. The liquid delivery circuit 75 is adapted to allow the flowing of a liquid into the tub 3 by gravity. The liquid delivery circuit 75 preferably comprises a main delivery pipe 76.

Advantageously the dispenser 60 comprises a water supply circuit 70 associated to the housing 61 and placed above the drawer 66 in such a way to allow the flowing of water to one or more of the compartments 67, 68 and 69.

The water supply circuit 70 preferably comprises inlet lines 80, 81, 82 connected to an external water supply line for the adduction of cold water and provided with respective control valves 71, 72 and 73. The control valves 71, 72 and 73 are opportunely driven by the control unit 33 for selectively supplying water to the compartments 67, 68 and 69.

In the compartments 67, 68 and 69 water mixes with the washing and/or rinsing products therein contained, and then flows in the tub 3 through the main delivery pipe 76 of the liquid delivery circuit 75.

The dispenser may be for example the dispenser described in EP2241669 which is assigned to the same assignee as the present application and is hereby incorporated by reference.

The detergent supply system 65 advantageously comprises a container 86 provided with an aperture 87 closable by means of an access door 88 associated to the casing 2.

Opening of the access door 88 allows the insertion of a suitable quantity $Q_d$ of detergent D inside the container 86.

The detergent supply system 65 advantageously comprises an inlet water line 89 to supply clean water W into the container 86.

The inlet water line 89 preferably comprises a supply pipe 90, connected to an external water supply line, provided with a first input valve 92 properly controlled.

The inlet water line 89 also preferably comprises a water flow sensor, for example a flow meter, which makes it possible to calculate the quantity of water W supplied into the container 86.

The detergent supply system 65 advantageously comprises an output circuit 94 to allow withdrawing of liquid from the container 86.

The output circuit 94 preferably comprises a delivery pipe 95 provided with a delivery pump 97 properly controlled.

The delivery pipe 95 preferably ends with its terminal part 95*a* in correspondence of the main wash detergent compartment 67 of the removable drawer 66.

The detergent supply system 65 advantageously comprises a mixing device 100 which is applied to the container 86 and comprises a recirculation mixing pump 101, an inlet connecting line 102 connecting the recirculation mixing pump 101 to the container 86 and an outlet connecting line 103 connecting the recirculation mixing pump 101 to the container 86.

The recirculation mixing pump 101 is activated to recirculate the liquid inside the container 86. The recirculation mixing pump 101 withdraws liquid from the container 86 via the inlet connecting line 102 and discharges the liquid withdrawn back into the container 86 via the outlet connecting line 103.

In a preferred embodiment, the container 86 and the housing 61 of the dispenser 60 form a module which is applied to the casing 2 by means of suitable fixing means.

The preferred embodiment of the laundry washing machine 1 and of the detergent supply system 65 works as follows.

The laundry to be washed is first placed inside the drum 4. By operating on the interface unit 34 the user selects the desired washing program depending, for example, on the type and on the dirty-level of the products to wash. Furthermore, as said before, in a preferred embodiment it is possible for the user to insert some parameters directly by the interface unit 34, for example the value of the washing temperature, the rotating speed of the drum 4 in the spinning phase, the duration of washing cycle, etc.

The user loads a prefixed quantity Qd of detergent D sufficient for washing the laundry. The user loads the prefixed quantity Qd of detergent inside the container 86 through the aperture 87. The aperture 87 is easily accessible by opening of the access door 88.

Once the user has selected the desired washing program, the control unit 33 sets the laundry washing machine 1 so that it starts the washing cycle.

A first quantity $Q1_w$ of clean water W is then introduced into the container 86 through the supply pipe 90 by opening the first input valve 92.

The first quantity $Q1_w$ of clean water W introduced in the container 86 may be measured, during its introduction, for example by a flow meter provided in the inlet water line 89, or by processing other parameters, for example the pressure of the delivered water and the duration of the water delivery; in this way it is possible to introduce into the container 86 exactly the prefixed quantity $Q1_w$ of clean water W.

The prefixed quantity Qd of detergent D and the first quantity $Q1_w$ of clean water W inside the container 86 form a washing solution S intended to wet the laundry. The recirculation mixing pump 101 is then activated to recirculate the liquid inside the container 86 in order to prepare a uniform washing solution S.

The recirculation process allows the preparation of a uniform washing solution S wherein the detergent D is properly dissolved or dispersed in the clean water W. The recirculation process takes place for a predetermined lapse of time $t_r$ so as to guarantee good mixing of the detergent D in the clean water W.

The washing solution S is then introduced in the main wash detergent compartment 67 of the removable drawer 66 through the delivery pipe 95 by means of the activation of the delivery pump 97. The washing solution S may be preferably introduced in the main wash detergent compartment 67 in a single step or, in a different embodiment, in successive steps by activating sequentially the delivery pump 97.

From the main wash detergent compartment 67 the washing solution S may be then directly introduced into the tub 3 through the main delivery pipe 76 of the liquid delivery circuit 75.

In a further embodiment, the washing solution S introduced in the main wash detergent compartment 67 of the removable drawer 66 through the delivery pipe 95 and coming from the container 86 may be mixed with a second quantity $Q2_w$ of clean water W.

The second quantity $Q2_w$ of clean water W is advantageously introduced into the main wash detergent compartment 67 through the water supply circuit 70 by opening the respective valve 71.

The second quantity $Q2_w$ of clean water W may be preferably introduced in a single step or, in a different embodiment, in successive steps by opening sequentially the valve 71.

Once the introduction of the washing solution S inside the tub 3 has been completed, with or without the addition of a second quantity $Q2_w$ of clean water W, the washing program may continue with the following phases of the selected washing cycle.

The amount of the second quantity $Q2_w$ of clean water W added to the washing solution S depends mainly on the quantity (i.e. weight) of loaded laundry and on the type of laundry. In fact, for example, cotton absorbs much more water than synthetic fibres, and therefore a certain quantity of laundry made of cotton requires, in order to be completely wetted, much water that a same quantity of laundry made of synthetic fibres. The control unit 33 may be advantageously configured in such a way to state (e.g. to calculate by applying a prefixed algorithm or to select among a series of memorized values) which is the amount of the first quantity $Q1_w$ and also of the second quantity $Q2_w$ in order to obtain a suitable water-detergent ratio value and therefore to obtain the better washing performances.

The weight of the laundry can be obtained by the control unit 33 in different ways. The weight can be, for example, one of the parameters introduced by the user when setting the washing program or can be advantageously obtained by means of suitable weight sensors provided in the laundry washing machine 1, for example sensors that can be associated with the shock-absorbers of the tub 3. Clearly any other method may be used to determine the quantity of the loaded laundry.

In the following phases of the washing cycle when further quantities of clean water are required, as for example during the rinse phase, the detergent supply system 65 may be used to supply such a water inside the tub 3.

In a preferred embodiment the required clean water flows through the supply pipe 90, the container 86, the delivery pipe 95, the main wash detergent compartment 67, the water delivery circuit 75 and finally reaches the tub 3. During this phase, the first input valve 92 and the delivery pump 97 of the output circuit 94 are properly driven by the control unit 33.

In a further embodiment, the required clean water may be supplied by making it flow through the main wash detergent compartment 67 of the drawer 66, bypassing the detergent supplying system 65. In this case the required clean water flows through the water supply circuit 70 of the dispenser 60, the main wash detergent compartment 67, the water delivery circuit 75 and finally reaches the tub 3.

It has to be noted that in this embodiment the laundry washing machine may work in a traditional way, i.e. using the dispenser 60 and the removable drawer 66 in a traditional way by introducing detergent D in the main wash compartment 67. In this case the selected washing cycle will not provide for the use of the detergent supply system 65 and will not provide for the mixing phase of detergent D and clean water W.

Advantageously, the interface unit 34 may be supplied with a programs selector allowing the user to select between a traditional washing program or a different program involving the mixing phase. The programs selector may be, for example, a mechanical knob or a touch screen selector of an interface display.

In further embodiment, the washing solution S from the container 86 may be introduced in any of the other compartments 68, 69 of the removable drawer 66. In this case, the delivery pipe 95 of the output circuit 94 will preferably end with its terminal part 95*a* in correspondence of the selected compartment 68, 69.

Figure 13:
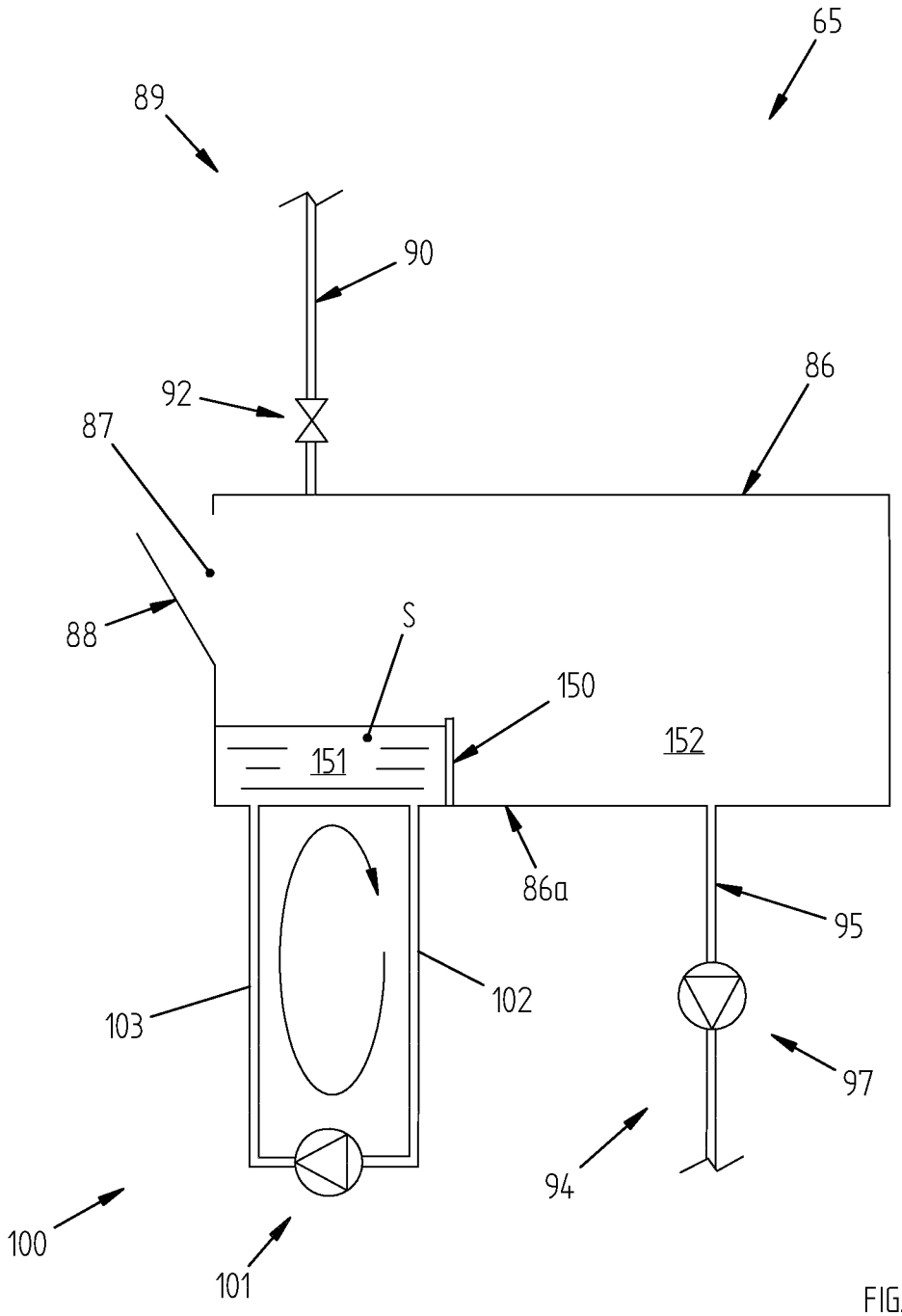
FIG. 13 shows a preferred embodiment of a particular of FIG. 9.

In FIG. 13 a preferred embodiment of the detergent supply system 65 of the type shown in FIG. 9 is disclosed.

In this detergent supply system 65 the mixing device 100 is advantageously applied to the bottom part 86*a* of the container 86 in a position close to the its aperture 87.

The container 86 further comprises a separation wall 150 so as to define a first containing portion 151 and a second containing portion 152 inside the container 86.

The inlet water line 89 with the supply pipe 90 and the first input valve 92 is properly placed over the first containing portion 151.

The detergent D is advantageously inserted in the first containing portion 151 through the aperture 87 by the user and the water W is advantageously conveyed in the same first containing portion 151 by the inlet water line 89.

Recirculation of the liquid takes place in the first containing portion 151 when the recirculation mixing pump 101 is activated.

More particularly, the detergent and the water are substantially mixed along the inlet connecting line 102 and the outlet connecting line 103 connecting the recirculation mixing pump 101 to the container 86.

Once the solution S has been properly mixed in the first containing portion 151, a further quantity of water is delivered by the inlet water line 89 so as to increase the level of the solution S inside the first containing portion 151. The solution S therefore passes over the separation wall 150 and reaches the adjacent second containing portion 152 of the container 86. From there, as described above, the output circuit 94 allow withdrawing of the solution S which is conveyed towards the main wash detergent compartment 67 of the removable drawer 66 by means of the activation of the delivery pump 97.

In further embodiment the solution S may be conveyed directly towards the tub 3. In this case the solution S may flow through the delivery pipe 95 by gravity and the delivery pump may be omitted.

Figures from 14 to 16 show a construction variant of the previous embodiment shown in Figures from 9 to 12.

Figure 14:
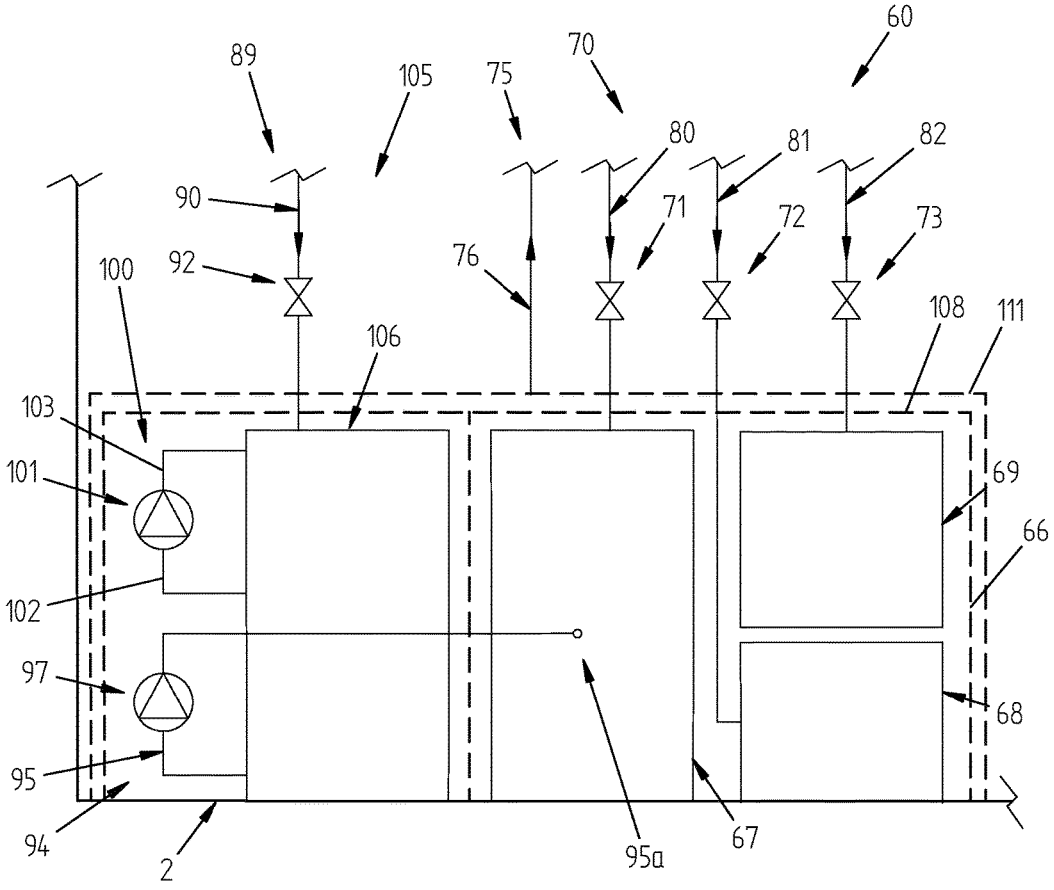
FIG. 14 shows a construction variant of FIG. 9 in a first operating condition.
Figure 15:
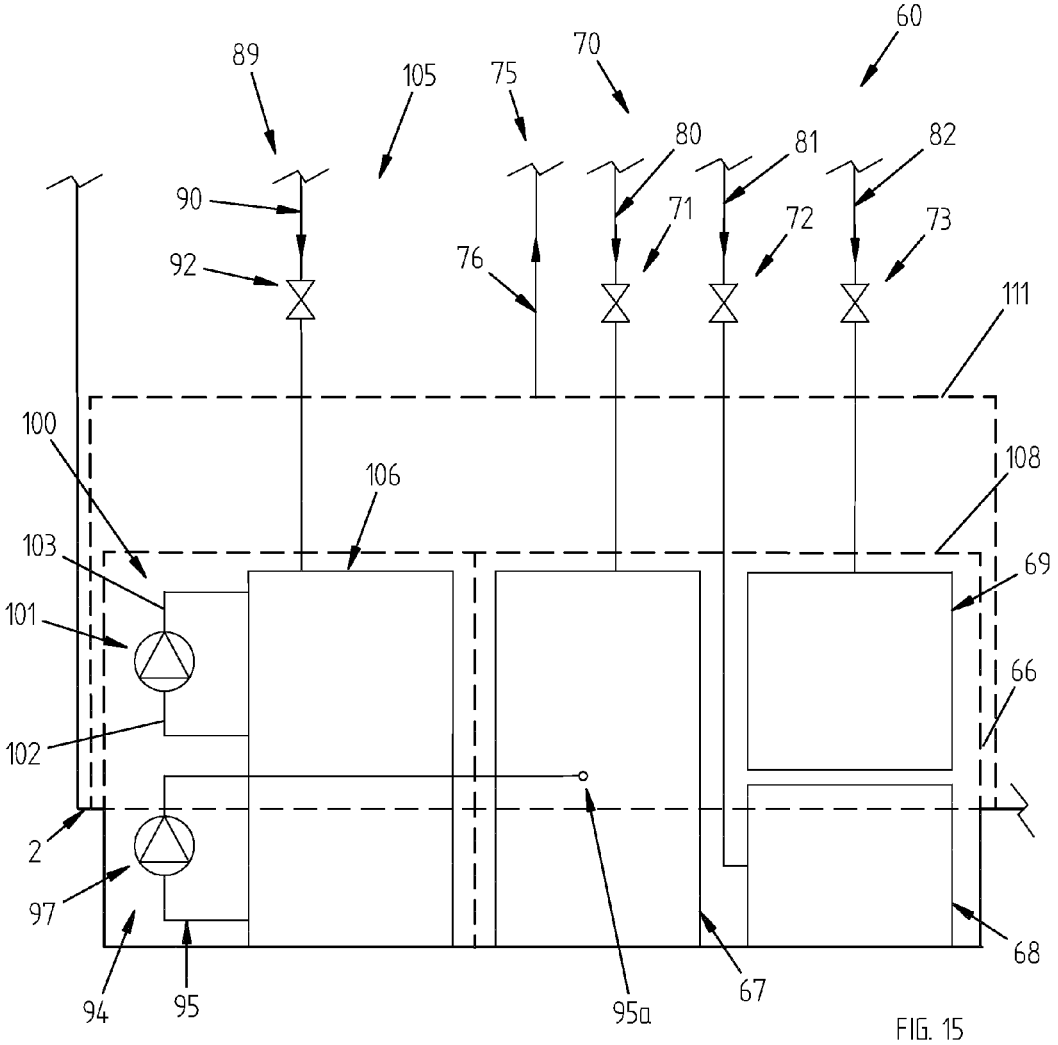
FIG. 15 shows the particular of FIG. 14 in a second operating condition.

This embodiment differs from the previous one for the fact that the detergent supply system 105 comprises a container 106 which is open in its upper part so as to define an aperture 107, as shown in FIG. 15. The container 106 is slidable with respect to the casing 2 and forms an integral unit 108 with the removable drawer 66, wherein the integral unit 108 and the removable drawer 66 are both indicated by a dashed line in FIGS. 14 and 15. The container 106 and the removable drawer 66 are received in a common receiving housing 111. The container 106 and the removable drawer 66, therefore, advantageously form a module which is applied to the casing 2 by means of suitable fixing means.

Figure 16:
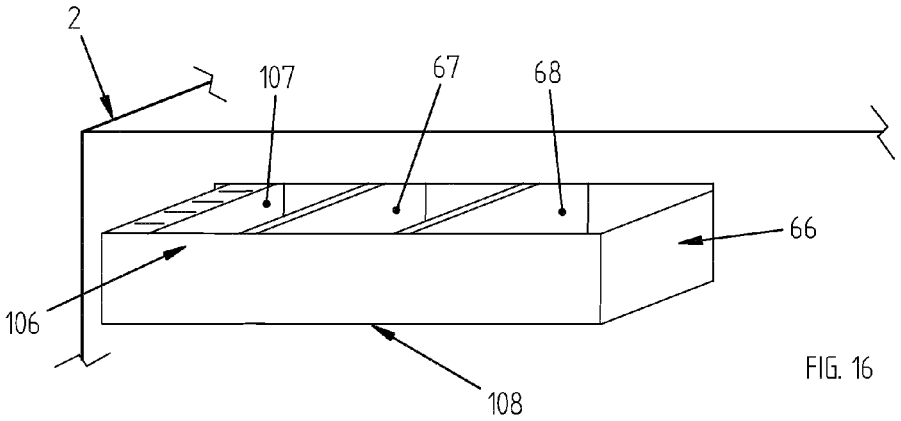
FIG. 16 shows a front view of a particular of the laundry washing machine of the invention referred to in the embodiment of FIG. 15.

The container 106 and the removable drawer 66 may be both positioned in a closed first operating condition, as shown in FIG. 14, and in an opened second operating condition, as shown in FIGS. 15 and 16.

In the second operating condition the container 106 and the compartments 67, 68, 69 may be easily filled with detergent the D and other products, i.e. bleach, softener, etc.

In the embodiments above described and illustrated the aperture of the container is directly accessible from outside of the casing. In further embodiments, nevertheless, one or more intermediate containers may be present between the container and the outside. For example, an intermediate detergent storage box easily accessible from outside may be placed inside the casing. The storage box may be completely filled with detergent by the user and, when necessary, prefixed quantities of detergent may be withdrawn from it and opportunely conveyed to the container for the use according to the washing cycle above described.

It has thus been shown that the present invention allows all the set objects to be achieved. In particular, it makes it possible to obtain a laundry washing machine with a system for mixing detergent presenting a reduced constructional complexity with respect to the laundry washing machine of known type.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

It is underlined that the laundry washing machines illustrated in the enclosed figures are of the front-loading type; however it is clear that the invention can be applied as well to a top-loading washing machine, substantially without any modification.

The invention claimed is:

1. A laundry washing machine comprising:

a casing supporting a washing tub external to a washing drum suitable to receive the laundry to be washed;

a detergent supply system comprising a container suitable to receive detergent and water and a mixing device suitable to mix said detergent and said water to form a washing solution, wherein said container and said mixing device are disposed inside said casing and said container comprises a supply water inlet, an inlet accessible from outside of the casing for the insertion of said detergent and an outlet for delivering said washing solution in said washing tub, and wherein said mixing device comprises a recirculating device separate from said supply water inlet, including a recirculating circuit with a recirculating pump that draws washing solution from said container and returns washing solution to said container without passing into said washing tub, wherein said detergent and said water are substantially mixed along said recirculating circuit.

2. A washing machine according to claim 1, wherein said container is stationary with respect to said casing.

3. A washing machine according to claim 1, wherein said container is slidable with respect to said casing.

4. A washing machine according to claim 1, further comprising an interface unit through which the user may select a washing program using said container to form a washing solution.

5. A laundry washing machine comprising:

a casing supporting a washing tub external to a washing drum suitable to receive the laundry to be washed;

a detergent supply system comprising a container suitable to receive detergent and water and a mixing device suitable to mix said detergent and said water to form a washing solution, wherein said container and said mixing device are disposed inside said casing and said container comprises an inlet accessible from outside of the casing for the insertion of said detergent and an outlet for delivering said washing solution in said washing tub, and wherein said mixing device comprises a recirculating device separate from a supply water inlet of said container, including a recirculating circuit with a recirculating pump that draws washing solution from said container and returns washing solution to said container without passing into said washing tub, wherein said detergent and said water are substantially mixed along said recirculating circuit; and a dispenser having at least one compartment suitable to receive washing and/or rinsing products, wherein said outlet of said container communicates with said at least one compartment to deliver washing solution from said container to said at least one compartment, said dispenser comprising a water supply inlet separate from said container and said mixing device, that supplies water to said compartment, and a liquid delivery outlet for delivery of the contents of said at least one compartment to the washing tub.

6. A washing machine according to claim 5, wherein said dispenser and said container form a module connectable to said casing.

7. A washing machine according to claim 5, wherein said outlet comprises a delivery pump.

8. A washing machine according to claim 5, wherein said dispenser comprises a removable drawer.

9. A washing machine according to claim 8, wherein said removable drawer and said container form an integral unit slidable with respect to said casing.

* * * * *